US011423818B2

(12) United States Patent
Kato

(10) Patent No.: US 11,423,818 B2
(45) Date of Patent: Aug. 23, 2022

(54) METHOD OF DETERMINING PIXEL LUMINANCE AND DISPLAY DEVICE EMPLOYING THE SAME

(71) Applicant: Samsung Display Co., LTD., Yongin-si (KR)

(72) Inventor: Takeshi Kato, Hwaseong-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 17/476,411

(22) Filed: Sep. 15, 2021

(65) Prior Publication Data

US 2022/0189366 A1 Jun. 16, 2022

(30) Foreign Application Priority Data

Dec. 14, 2020 (KR) ..... 10-2020-0174134

(51) Int. Cl.
*G09G 3/20* (2006.01)
*G09G 3/3208* (2016.01)

(52) U.S. Cl.
CPC ..... *G09G 3/20* (2013.01); *G09G 3/3208* (2013.01); *G09G 2320/0686* (2013.01); *G09G 2340/0457* (2013.01); *G09G 2340/145* (2013.01); *G09G 2360/16* (2013.01)

(58) Field of Classification Search
CPC ..... G09G 3/3208; G09G 2320/0686; G09G 2340/0457; G09G 2360/16
See application file for complete search history.

(56) References Cited

U.S. PATENT DOCUMENTS

| | | | | |
|---|---|---|---|---|
| 10,497,098 | B2 | 12/2019 | Hsu | |
| 10,748,467 | B2 * | 8/2020 | Yang | G09G 3/2003 |
| 11,170,739 | B2 * | 11/2021 | Li | G09G 3/20 |
| 2018/0122283 | A1 * | 5/2018 | Kim | G09G 3/2003 |
| 2019/0349519 | A1 | 11/2019 | Lee et al. | |
| 2021/0375191 | A1 * | 12/2021 | Sun | G09G 3/20 |

FOREIGN PATENT DOCUMENTS

| | | |
|---|---|---|
| JP | 6549971 | 7/2019 |
| JP | 6633134 | 1/2020 |
| KR | 2019-0128959 | 11/2019 |

* cited by examiner

*Primary Examiner* — Gene W Lee
(74) *Attorney, Agent, or Firm* — H.C. Park & Associates, PLC

(57) ABSTRACT

A method of determining a pixel luminance including determining a smoothing reference line between a display region and a non-display region in a display panel, determining a boundary pixel through which the smoothing reference line passes among pixels included in the display region, dividing the boundary pixel into a first pixel region directed toward the display region and a second pixel region directed toward the non-display region based on the smoothing reference line, calculating a smoothing rate corresponding to a ratio of an area of the first pixel region to a total area of the boundary pixel, and determining a dimming luminance of the boundary pixel based on the smoothing rate.

20 Claims, 10 Drawing Sheets

METHOD OF DETERMINING PIXEL LUMINANCE AND DISPLAY DEVICE EMPLOYING THE SAME

CROSS-REFERENCE TO RELATED APPLICATION

This application claims priority from and the benefit of Korean Patent Application No. 10-2020-0174134, filed on Dec. 14, 2020, which is hereby incorporated by reference for all purposes as if fully set forth herein.

BACKGROUND

Field

Embodiments of the invention relate generally to inventive concepts a display device. More particularly, embodiments of the inventive concepts relate to a method of determining a pixel luminance and a display device employing the same, which are capable of performing luminance dimming on a boundary pixel located around a boundary between a display region and a non-display region (e.g., a trench region, a hole region, a corner region, etc.)
in a display panel.

Discussion of the Background

Recently, as design elements of electronic devices are emphasized, a display panel included in a display device includes a display region and a non-display region having various shapes. For example, a corner region of the display panel may be processed to be a curved line so that a boundary between the display region and the non-display region may be a curved line, and the display region may include a hole region or a trench region through which light for an operation of an optical module (e.g., a camera module, a sensor module, etc.) is transmitted so that the boundary between the display region and the non-display region may be a curved line. However, since pixels included in the display panel generally have a polygonal shape (e.g., a rectangular shape), even when the boundary between the display region and the non-display region is the curved line, a step difference may be generated by the pixels, so that deterioration of display quality that may occur when a user recognizes the step difference may occur.

The above information disclosed in this Background section is only for understanding of the background of the inventive concepts, and, therefore, it may contain information that does not constitute prior art.

SUMMARY

Embodiments of the inventive concepts provide a method of determining a pixel luminance, capable of preventing a step difference from being generated by pixels even when a boundary between a display region and a non-display region in a display panel is a curved line having a plurality of curvatures.

Embodiments of the inventive concepts also provide a display device employing the method of determining the pixel luminance.

Additional features of the inventive concepts will be set forth in the description which follows, and in part will be apparent from the description, or may be learned by practice of the inventive concepts.

An embodiment of the inventive concepts provides a method of determining a pixel luminance, the method including determining a smoothing reference line between a display region and a non-display region in a display panel, determining a boundary pixel through which the smoothing reference line passes among pixels included in the display region, dividing the boundary pixel into a first pixel region directed toward the display region and a second pixel region directed toward the non-display region based on the smoothing reference line, calculating a smoothing rate corresponding to a ratio of an area of the first pixel region to a total area of the boundary pixel and determining a dimming luminance of the boundary pixel based on the smoothing rate. When the smoothing reference line has a plurality of curvatures, the smoothing reference line is divided into a plurality of sub-smoothing reference lines corresponding to each of the curvatures, the smoothing rate are calculated based on each of the sub-smoothing reference lines, and luminance dimming of the boundary pixel corresponding to the sub-smoothing reference line are performed based on the smoothing rate.

The sub-smoothing reference lines are parts of circumferences of circles having mutually different radii, respectively.

The dimming luminance of the boundary pixel may be calculated by multiplying a luminance of the boundary pixel by the smoothing rate.

A dimming luminance of each of sub-pixels included in the boundary pixel is calculated by multiplying a luminance of each of the sub-pixels by the smoothing rate.

The smoothing reference line includes a curved line that is bent convexly toward the display region.

The non-display region includes a trench region or a hole region for an optical module disposed under the display panel.

The smoothing reference line includes a curved line that is bent convexly toward the non-display region.

The non-display region includes a corner region of the display panel.

The method may further include detecting a target sub-pixel disposed only in the second pixel region among sub-pixels included in the boundary pixel and additionally reducing the smoothing rate in which a luminance of the target sub-pixel is to be multiplied by the smoothing rate.

The method may further include detecting a target sub-pixel having a major area in the second pixel region among sub-pixels included in the boundary pixel and additionally reducing the smoothing rate in which a luminance of the target sub-pixel is to be multiplied by the smoothing rate.

Another embodiment of the inventive concepts provides a display device including a display panel including a display region and a non-display region, and a display panel driving circuit configured to drive the display panel. The display panel driving circuit determines a smoothing reference line between the display region and the non-display region in the display panel, determines a boundary pixel through which the smoothing reference line passes among pixels included in the display region, divides the boundary pixel into a first pixel region directed toward the display region and a second pixel region directed toward the non-display region based on the smoothing reference line, calculates a smoothing rate corresponding to a ratio of an area of the first pixel region to a total area of the boundary pixel, determines a dimming luminance of the boundary pixel based on the smoothing rate, and performs luminance compensation for reflecting the dimming luminance of the boundary pixel on image data. When the smoothing reference line has a plurality of curvatures, the display panel driving circuit may divides the smoothing reference line into a plurality of sub-smoothing reference lines corresponding to each of the curvatures, calculates the smoothing rate based on each of the sub-smoothing reference lines, and performs luminance dimming of the boundary pixel corresponding to the sub-smoothing reference line based on the smoothing rate.

The sub-smoothing reference lines are parts of circumferences of circles having mutually different radii, respectively.

The display panel driving circuit is configured to calculate the dimming luminance of the boundary pixel by multiplying a luminance of the boundary pixel by the smoothing rate.

The display panel driving circuit is configured to calculate a dimming luminance of each of sub-pixels included in the boundary pixel by multiplying a luminance of each of the sub-pixels by the smoothing rate.

The smoothing reference line includes a curved line that is bent convexly toward the display region.

The non-display region includes a trench region or a hole region for an optical module disposed under the display panel.

The smoothing reference line includes a curved line that is bent convexly toward the non-display region.

The non-display region includes a corner region of the display panel.

The display panel driving circuit may detect a target sub-pixel disposed only in the second pixel region among sub-pixels included in the boundary pixel and additionally reduce the smoothing rate in which a luminance of the target sub-pixel is to be multiplied by the smoothing rate.

The display panel driving circuit may detect a target sub-pixel having a major area in the second pixel region among sub-pixels included in the boundary pixel and additionally reduce the smoothing rate in which a luminance of the target sub-pixel is to be multiplied by the smoothing rate.

According to embodiments of the inventive concepts, the method of determining the pixel luminance may include determining a smoothing reference line between a display region and a non-display region in a display panel, determining a boundary pixel through which the smoothing reference line passes among pixels included in the display region, and determining whether the smoothing reference line has a plurality of curvatures. When the smoothing reference line has the plurality of curvatures, the smoothing reference line having the curvatures is divided into a plurality of sub-smoothing reference lines to determine a dimming luminance of the boundary pixel, so that a step difference can be prevented from being generated by pixels even when a boundary between the display region and the non-display region in the display panel is a curved line having a plurality of curvatures. As a result, deterioration of display quality that may occur when a user recognizes the step difference may be prevented.

According to embodiments of the inventive concepts, a display device may employ the method of determining the pixel luminance, so that the step difference can be prevented from being generated by the pixels even when the boundary between the display region and the non-display region in the display panel is the curved line having the plurality of curvatures, and thus, a high-quality image can be provided to the user.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate exemplary embodiments of the invention, and together with the description serve to explain the inventive concepts.

DETAILED DESCRIPTION

Figure 1:
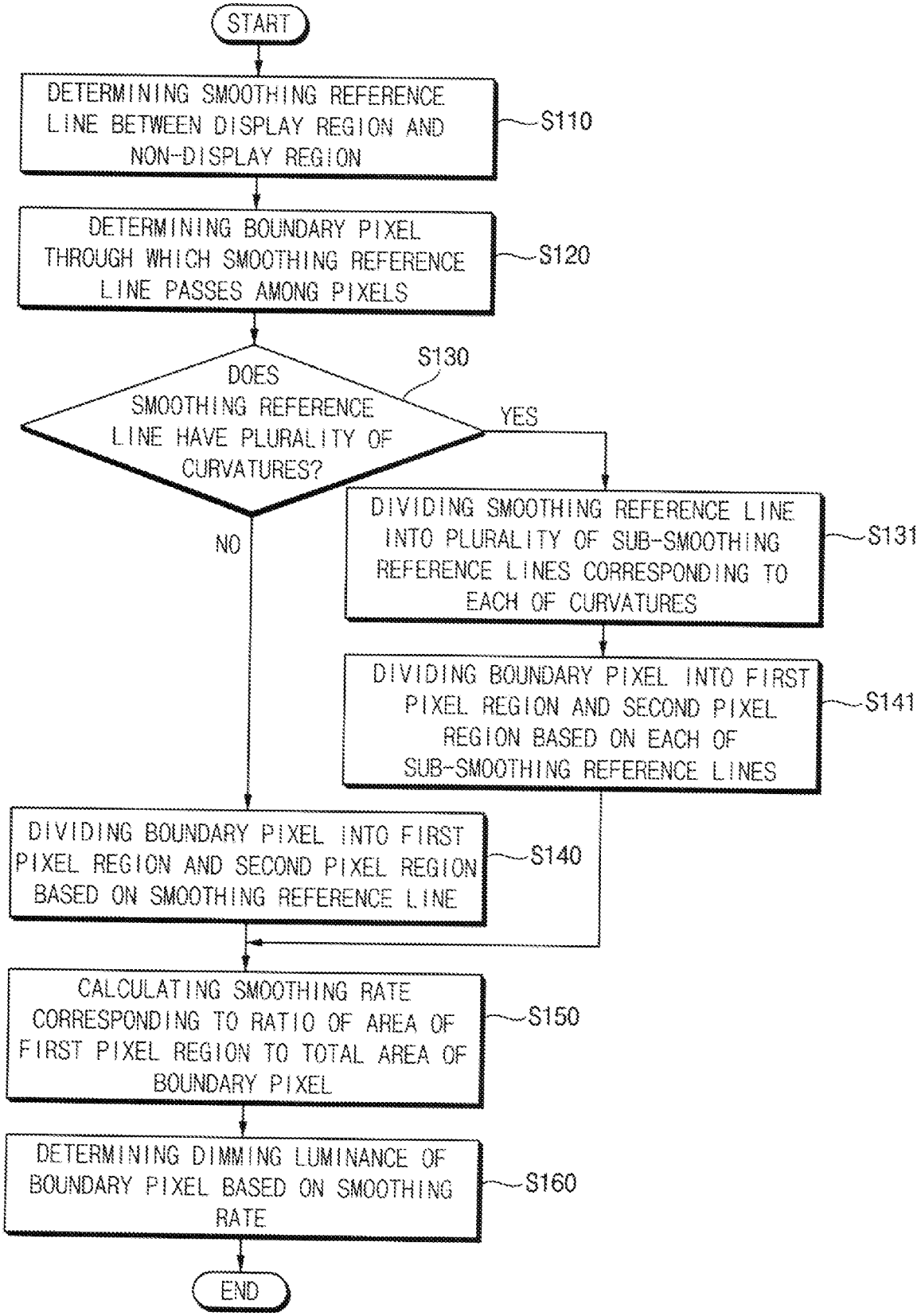
FIG. 1 is a flowchart illustrating a method of determining a pixel luminance according to embodiments of the inventive concepts.

In the following description, for the purposes of explanation, numerous specific details are set forth in order to provide a thorough understanding of various exemplary embodiments or implementations of the invention. As used herein "embodiments" and "implementations" are interchangeable words that are non-limiting examples of devices or methods employing one or more of the inventive concepts disclosed herein. It is apparent, however, that various exemplary embodiments may be practiced without these specific details or with one or more equivalent arrangements. In other instances, well-known structures and devices are shown in block diagram form in order to avoid unnecessarily obscuring various exemplary embodiments. Further, various exemplary embodiments may be different, but do not have to be exclusive. For example, specific shapes, configurations, and characteristics of an exemplary embodiment may be used or implemented in another exemplary embodiment without departing from the inventive concepts.

Unless otherwise specified, the illustrated exemplary embodiments are to be understood as providing exemplary features of varying detail of some ways in which the inventive concepts may be implemented in practice. Therefore, unless otherwise specified, the features, components, modules, layers, films, panels, regions, and/or aspects, etc. (hereinafter individually or collectively referred to as "elements"), of the various embodiments may be otherwise combined, separated, interchanged, and/or rearranged without departing from the inventive concepts.

The use of cross-hatching and/or shading in the accompanying drawings is generally provided to clarify boundaries between adjacent elements. As such, neither the presence nor the absence of cross-hatching or shading conveys or indicates any preference or requirement for particular materials, material properties, dimensions, proportions, commonalities between illustrated elements, and/or any other characteristic, attribute, property, etc., of the elements, unless specified. Further, in the accompanying drawings, the size and relative sizes of elements may be exaggerated for clarity and/or descriptive purposes. When an exemplary embodiment may be implemented differently, a specific process order may be performed differently from the described order. For example, two consecutively described processes may be performed substantially at the same time or performed in an order opposite to the described order. Also, like reference numerals denote like elements.

When an element, such as a layer, is referred to as being "on," "connected to," or "coupled to" another element or layer, it may be directly on, connected to, or coupled to the other element or layer or intervening elements or layers may be present. When, however, an element or layer is referred to as being "directly on," "directly connected to," or "directly coupled to" another element or layer, there are no intervening elements or layers present. To this end, the term "connected" may refer to physical, electrical, and/or fluid connection, with or without intervening elements. Further, the D1-axis, the D2-axis, and the D3-axis are not limited to three axes of a rectangular coordinate system, such as the x, y, and z—axes, and may be interpreted in a broader sense. For example, the D1-axis, the D2-axis, and the D3-axis may be perpendicular to one another, or may represent different directions that are not perpendicular to one another. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. As used herein, the term "and/or" includes any and all combinations of one or more of the associated listed items.

Although the terms "first," "second," etc. may be used herein to describe various types of elements, these elements should not be limited by these terms. These terms are used to distinguish one element from another element. Thus, a first element discussed below could be termed a second element without departing from the teachings of the disclosure.

Spatially relative terms, such as "beneath," "below," "under," "lower," "above," "upper," "over," "higher," "side" (e.g., as in "sidewall"), and the like, may be used herein for descriptive purposes, and, thereby, to describe one elements relationship to another element(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the exemplary term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," "comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof. It is also noted that, as used herein, the terms "substantially," "about," and other similar terms, are used as terms of approximation and not as terms of degree, and, as such, are utilized to account for inherent deviations in measured, calculated, and/or provided values that would be recognized by one of ordinary skill in the art.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and should not be interpreted in an idealized or overly formal sense, unless expressly so defined herein.

Figure 2A:
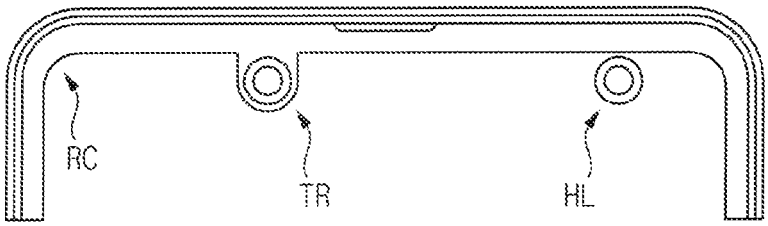
FIG. 2A and FIG. 2B are diagrams illustrating a display panel to which the method of determining the pixel luminance of FIG. 1 is applied.
Figure 2B:
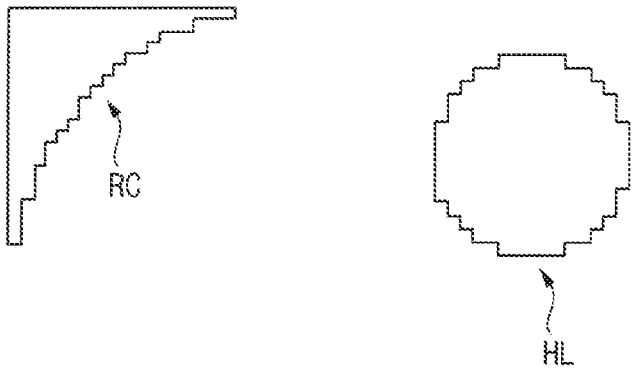
Figure 3:
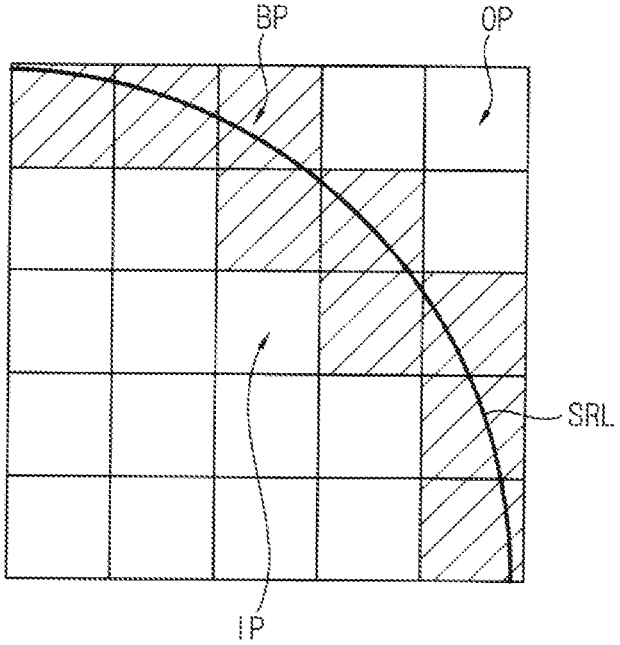
FIG. 3 and FIG. 4 are diagrams for describing the method of determining the pixel luminance of FIG. 1.
Figure 4:
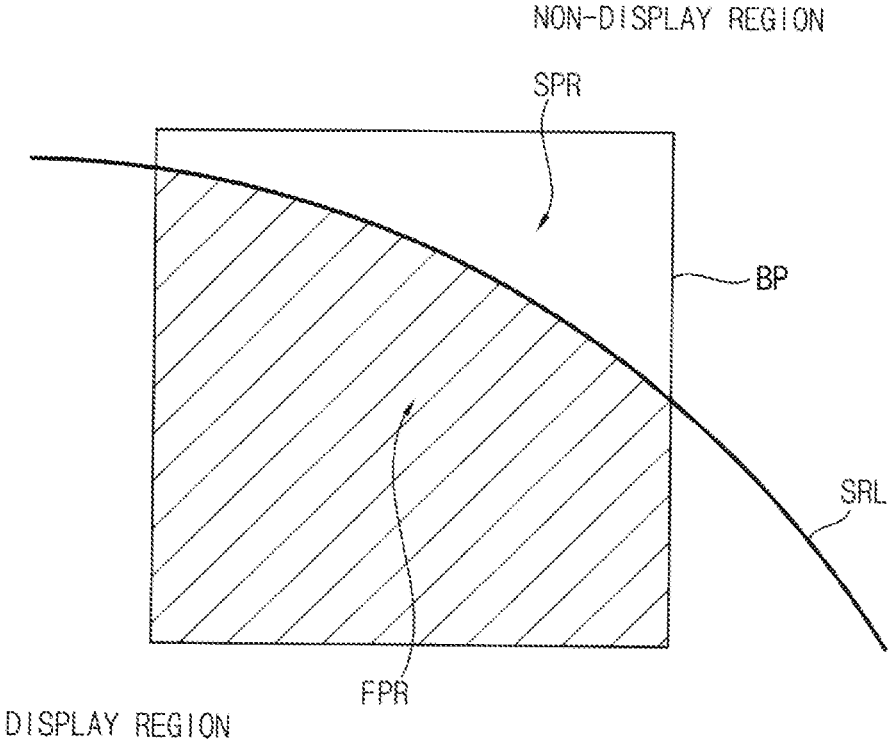
Figure 5:
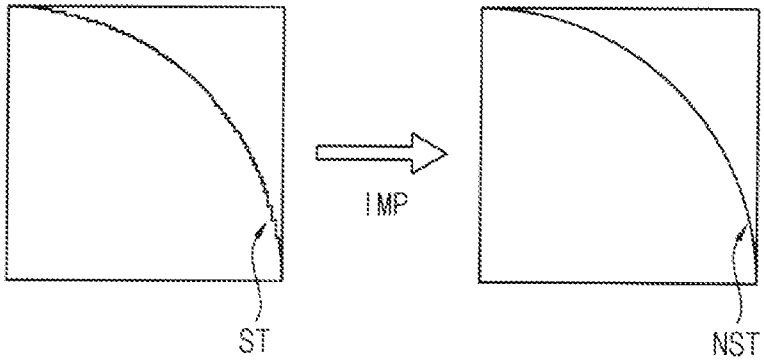
FIG. 5 is a diagram illustrating one example in which a boundary between a display region and a non-display region is improved by the method of determining the pixel luminance of FIG. 1.
Figure 6:
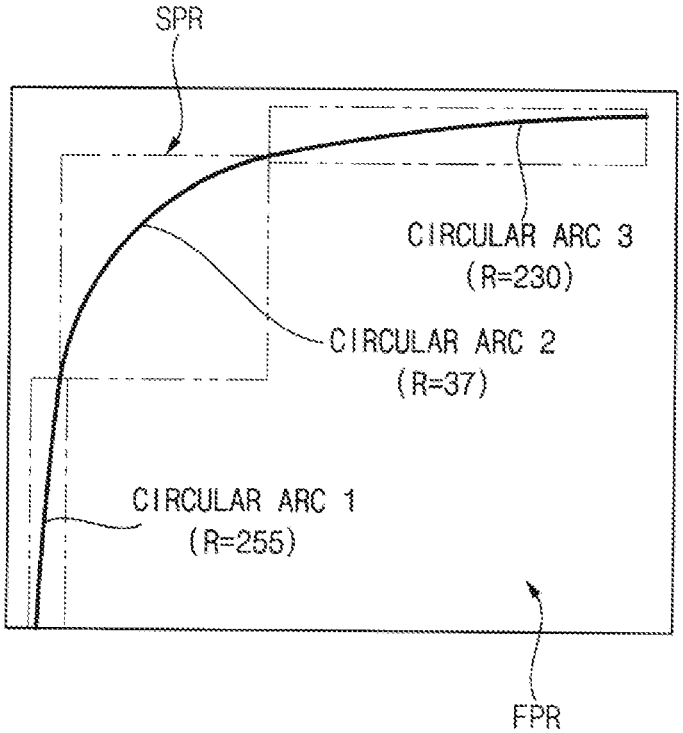
FIG. 6 is a diagram illustrating one example of a smoothing reference line having a plurality of curvatures.
Figure 7:
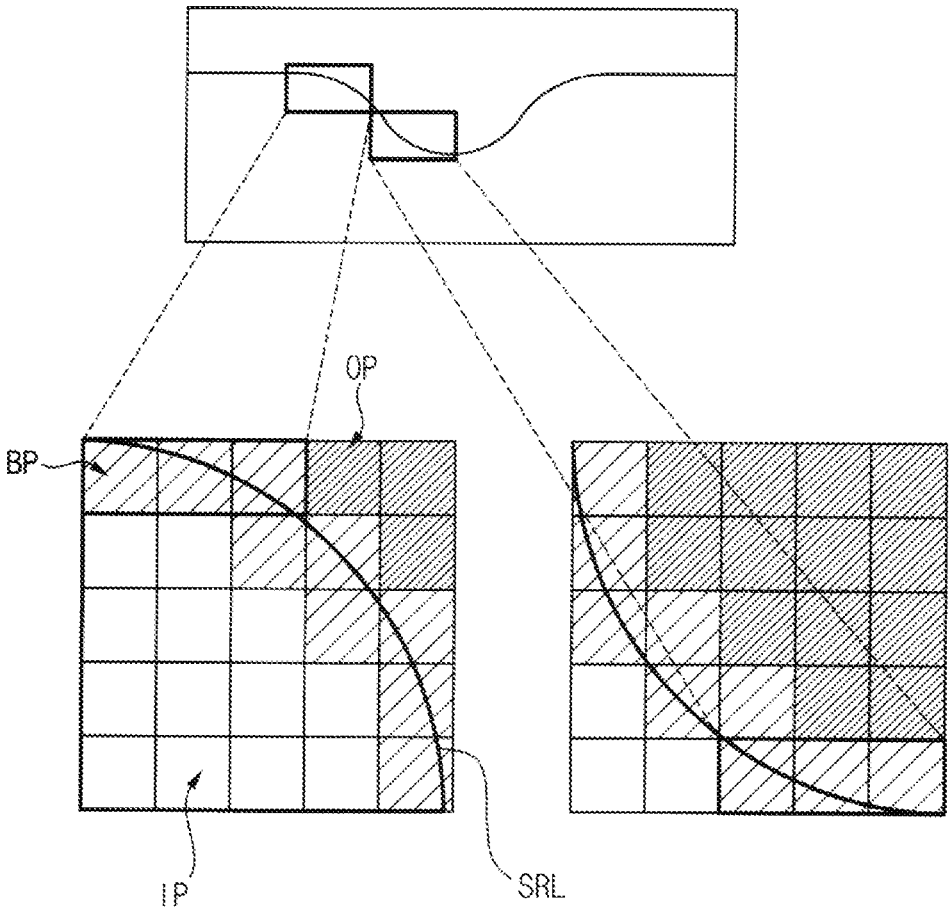
FIG. 7 is a diagram illustrating the display panel to which the method of determining the pixel luminance is applied when the smoothing reference line has the curvatures.
Figure 8:
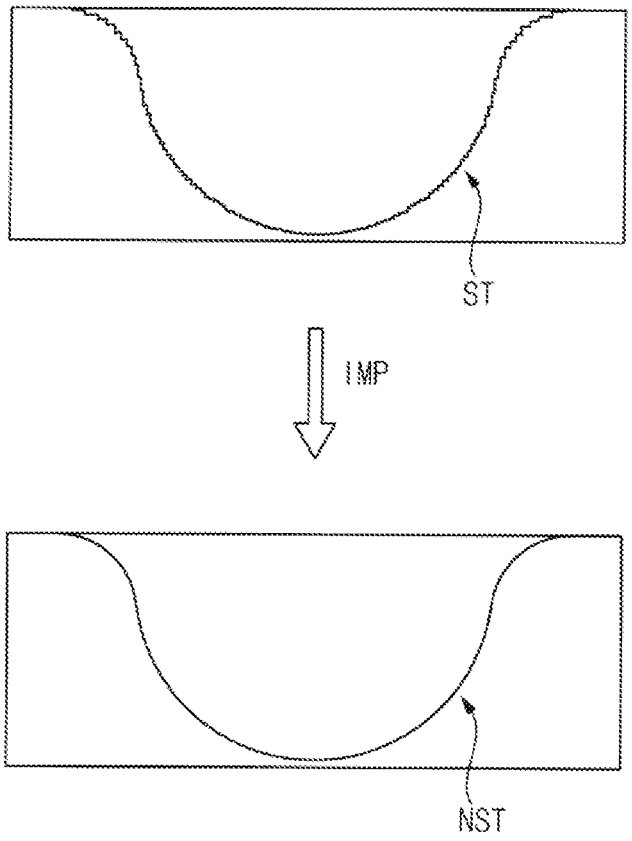
FIG. 8 is a diagram illustrating another example in which the boundary between the display region and the non-display region is improved by the method of determining the pixel luminance of FIG. 1.

FIG. 1 is a flowchart illustrating a method of determining a pixel luminance according to embodiments of the inventive concepts; FIGS. 2A and 2B are diagrams illustrating a display panel to which the method of determining the pixel luminance of FIG. 1 is applied; FIGS. 3 and 4 are diagrams for describing the method of determining the pixel luminance of FIG. 1; and FIG. 5 is a diagram illustrating one example in which a boundary between a display region and a non-display region is improved by the method of determining the pixel luminance of FIG. 1. FIG. 6 is a diagram illustrating one example of a smoothing reference line having a plurality of curvatures; FIG. 7 is a diagram illustrating the display panel to which the method of determining the pixel luminance is applied when the smoothing reference line has the curvatures; and FIG. 8 is a diagram illustrating another example in which the boundary between the display region and the non-display region is improved by the method of determining the pixel luminance of FIG. 1.

Referring to FIGS. 1 to 8, a method of determining a pixel luminance of FIG. 1 may include determining a smoothing reference line SRL between a display region and a non-display region in a display panel (S110), determining a boundary pixel BP through which the smoothing reference line SRL passes among pixels included in the display region (S120), and determining whether the smoothing reference line SRL has a plurality of curvatures (S130). When the smoothing reference line SRL does not have the plurality of curvatures, the method of determining the pixel luminance of FIG. 1 may include dividing the boundary pixel BP into a first pixel region FPR directed toward the display region and a second pixel region SPR directed toward the non-display region based on the smoothing reference line SRL (S140), calculating a smoothing rate corresponding to a ratio of an area of the first pixel region FPR to a total area of the boundary pixel BP (S150), and determining a dimming luminance of the boundary pixel BP based on the smoothing rate (S160). When the smoothing reference line SRL has the plurality of curvatures, the method of determining the pixel luminance of FIG. 1 may include dividing the smoothing reference line SRL into a plurality of sub-smoothing reference lines corresponding to each of the curvatures (S131), dividing the boundary pixel BP into a first pixel region FPR directed toward the display region and a second pixel region SPR directed toward the non-display region based on each of the sub-smoothing reference lines (S141), calculating a smoothing rate corresponding to a ratio of an area of the first pixel region FPR to a total area of the boundary pixel BP (S150), and determining a dimming luminance of the boundary pixel BP based on the smoothing rate (S160).

In detail, the method of determining the pixel luminance of FIG. 1 may include determining a smoothing reference line SRL between a display region and a non-display region in a display panel (S110), and determining a boundary pixel BP through which the smoothing reference line SRL passes among pixels included in the display region (S120). In general, a display panel includes a display region and a non-display region having various shapes. For example, as shown in FIG. 2A, a corner region of the display panel (i.e., denoted by RC) may be processed to be a curved line so that a boundary between the display region and the non-display region may be a curved line, and the display region may include a hole region (i.e., denoted by HL) or a trench region (i.e., denoted by TR) through which light for an operation of an optical module is transmitted so that the boundary between the display region and the non-display region may be a curved line. However, since pixels included in the display panel generally have a polygonal shape, as shown in FIG. 2B, even when the boundary between the display region and the non-display region is the curved line, a step difference may be generated by boundary pixels BP through which the smoothing reference line SRL passes, so that deterioration of display quality that may occur when a user recognizes the step difference may occur. In other words, while the user has to recognize the smoothing reference line SRL as the boundary between the display region and the non-display region, since second pixel regions SPR of the boundary pixels BP emit light, the user may recognize step differences caused by the second pixel region SPR of the boundary pixels BP. Accordingly, the method of determining the pixel luminance of FIG. 1 may include performing luminance dimming on the boundary pixel BP through which the smoothing reference line SRL passes so as to allow the user to recognize the smoothing reference line SRL as the boundary between the display region and the non-display region.

Referring to FIGS. 1 to 4, the method of determining the pixel luminance of FIG. 1 may include determining whether the smoothing reference line SRL has a plurality of curvatures (S130), and when the smoothing reference line SRL does not have the curvatures, the method of determining the pixel luminance of FIG. 1 may include dividing the boundary pixel BP into a first pixel region FPR directed toward the display region and a second pixel region SPR directed toward the non-display region based on the smoothing reference line SRL (S140). The method of determining the pixel luminance of FIG. 1 may be applied to both a case where the smoothing reference line SRL is a straight line and a case where the smoothing reference line SRL is a curved line having various shapes (e.g., a shape having a plurality of curvatures). The method of determining the pixel luminance may include determining whether the smoothing reference line SRL has the curvatures. When the smoothing reference line SRL does not have the curvatures, the method of determining the pixel luminance may include dividing the boundary pixel BP into the first pixel region FPR directed toward the display region and the second pixel region SPR directed toward the non-display region based on the smoothing reference line SRL without additionally dividing the smoothing reference line SRL. In one embodiment, as shown in FIG. 3, the smoothing reference line SRL may be a curved line that is bent convexly toward the non-display region. In this case, the non-display region may have a concave shape, and the display region may have a convex shape. For example, the non-display region may be a corner region RC of the display panel. In another embodiment, the smoothing reference line SRL may be a curved line that is bent convexly toward the display region. In this case, the non-display region may have a convex shape, and the display region may have a concave shape. For example, the non-display region may be a trench region TR or a hole region HL for an optical module disposed under the display panel. However, in the present embodiment, for convenience of description, the smoothing reference line SRL will be assumed as a curved line that is bent convexly toward the non-display region. In detail, as shown in FIG. 3, the display panel may include boundary pixels BP through which the smoothing reference line SRL passes, inner non-boundary pixels IP located in the display region, which do not allow the smoothing reference line SRL to pass therethrough, and outer non-boundary pixels OP located in the non-display region, which do not allow the smoothing reference line SRL to pass therethrough. Accordingly, as shown in FIG. 4, the boundary pixel BP may be divided into the first pixel region FPR directed toward the display region and the second pixel region SPR directed toward the non-display region based on the smoothing reference line SRL. The outer non-boundary pixels OP may not exist on the display panel, or may not emit light (e.g., the smoothing rate is 0) when the inner non-boundary pixels IP and the boundary pixels BP emit light.

Thereafter, the method of determining the pixel luminance of FIG. 1 may include calculating a smoothing rate corresponding to a ratio of an area of the first pixel region FPR to a total area of the boundary pixel BP (S150). For example, when the total area of the boundary pixel BP and the area of the first pixel region FPR are equal to each other (i.e., corresponding to the inner non-boundary pixel IP), the smoothing rate may be 1. Meanwhile, when the total area of the boundary pixel BP and the area of the second pixel region SPR are equal to each other (i.e., corresponding to the outer non-boundary pixel OP), the smoothing rate may be 0. Therefore, the smoothing rate to be applied to the boundary pixel BP may have a value that is greater than 0 and less than 1. For example, when the smoothing reference line SRL is a part of a circumference of a predetermined circle, coordinates of a center of the circle are denoted by (0, 0), a radius of the circle is denoted by R, the boundary pixel BP has a rectangular shape shown in FIG. 4, each of horizontal and vertical lengths of the rectangular shape shown in FIG. 4 is 1, coordinates of a first vertex (i.e., a vertex located on a lower left side) of the rectangular shape shown in FIG. 4 are denoted by (x, y), coordinates of a second vertex (i.e., a vertex located on a bottom right side) of the rectangular shape shown in FIG. 4 are denoted by (x+1, y), coordinates of a third vertex (i.e., a vertex located on an upper left side) of the rectangular shape shown in FIG. 4 are denoted by (x, y+1), and coordinates of a fourth vertex (i.e., a vertex located on an upper right side) of the rectangular shape shown in FIG. 4 are denoted by (x+1, y+1), the smoothing rate to be applied to the boundary pixel BP may be calculated by [Formula 1] and [Formula 2] as follows. However, since the above configuration has been provided for illustrative purposes, the calculation of the smoothing rate to be applied to the boundary pixel BP is not limited thereto.

$$SR = \frac{y^2(R^2 - (x^2 + y^2))}{(x^2 + y^2)(2y + 1)} \quad \text{[Formula 1]}$$

(where SR denotes a smoothing rate when x<y)

$$SR = \frac{x^2(R^2 - (x^2 + y^2))}{(x^2 + y^2)(2x + 1)} \quad \text{[Formula 2]}$$

(where SR denotes a smoothing rate when x>y)

The method of determining the pixel luminance of FIG. 1 may include determining a dimming luminance of the boundary pixel BP based on the smoothing rate (S160). In one embodiment, the dimming luminance of the boundary pixel BP may be calculated by multiplying a luminance of the boundary pixel BP by the smoothing rate. For example, when the luminance of the boundary pixel BP is denoted by A, the dimming luminance of the boundary pixel BP may be A×SR. As another example, when a luminance of the inner non-boundary pixel IP is denoted by B, a dimming luminance of the inner non-boundary pixel IP may be B×1=B. As still another example, when a luminance of the outer non-boundary pixel OP is denoted by C, a dimming luminance of the outer non-boundary pixel OP may be C×0=0. Furthermore, a dimming luminance of each of sub-pixels R, G, and B included in the boundary pixel BP may be calculated by multiplying a luminance of each of the sub-pixels R, G, and B by the smoothing rate SR. For example, when a luminance of a red sub-pixel R included in the boundary pixel BP is denoted by A1, a dimming luminance of the red sub-pixel R included in the boundary pixel BP may be A1×SR. For example, when a luminance of a green sub-pixel G included in the boundary pixel BP is denoted by A2, a dimming luminance of the green sub-pixel G included in the boundary pixel BP may be A2×SR. For example, when a luminance of a blue sub-pixel B included in the boundary pixel BP is denoted by A3, a dimming luminance of the blue sub-pixel B included in the boundary pixel BP may be A3×SR. As a result, as shown in FIG. 5, the boundary between the display region and the non-display region may be improved (i.e., denoted by IMP). In other words, while a conventional boundary (i.e., denoted by ST) may be configured such that a step difference is visually recognized by the user, the boundary improved by the method of determining the pixel luminance of FIG. 1 (i.e., denoted by NST) may be configured such that a step difference is not visually recognized by the user, or the visual recognition of the step difference is minimized (or reduced).

As described above, the method of determining the pixel luminance of FIG. 1 includes determining a smoothing reference line SRL between a display region and a non-display region in a display panel, determining a boundary pixel BP through which the smoothing reference line SRL passes among pixels included in the display region, dividing the boundary pixel BP into a first pixel region FPR directed toward the display region and a second pixel region SPR directed toward the non-display region based on the smoothing reference line SRL, calculating a smoothing rate corresponding to a ratio of an area of the first pixel region FPR to a total area of the boundary pixel BP, and determining a dimming luminance of the boundary pixel BP based on the smoothing rate (i.e., calculating a dimming luminance of the boundary pixel BP by multiplying a luminance of the boundary pixel BP by the smoothing rate), so that the step difference may be prevented from being generated by the pixels even when the boundary between the display region and the non-display region in the display panel is the curved line. As a result, the deterioration of the display quality that may occur when the user recognizes the step difference may be prevented. Although the method of determining the pixel luminance of FIG. 1 has been described above by assuming the smoothing reference line SRL as a curved line that is bent convexly toward the non-display region, the method of determining the pixel luminance of FIG. 1 is not limitedly applied to a specific shape of the smoothing reference line SRL. In other words, the method of determining the pixel luminance of FIG. 1 may be applied to both the case where the smoothing reference line SRL is a straight line and the case where the smoothing reference line SRL is a curved line having various shapes (e.g., a shape having a plurality of curvatures). Hereinafter, the case where the smoothing reference line SRL is a curved line having a plurality of curvatures will be described with reference to FIGS. 6 to 8.

Referring to FIGS. 1, 6, and 8, the method of determining the pixel luminance of FIG. 1 may include determining whether the smoothing reference line SRL has a plurality of curvatures (S130), and when the smoothing reference line SRL has the curvatures, the method of determining the pixel luminance of FIG. 1 may include dividing the smoothing reference line SRL into a plurality of sub-smoothing reference lines corresponding to each of the curvatures (S131), and dividing the boundary pixel BP into a first pixel region FPR directed toward the display region and a second pixel region SPR directed toward the non-display region based on each of the sub-smoothing reference lines (S141). In detail, the method of determining the pixel luminance of FIG. 1 may be applied to both the case where the smoothing reference line SRL is a straight line and the case where the smoothing reference line SRL is a curved line having various shapes (e.g., a shape having a plurality of curvatures). In order to more precisely perform the luminance dimming of the boundary pixel, the method of determining the pixel luminance may include determining whether the smoothing reference line SRL has the curvatures. In other words, the smoothing reference line SRL may have a plurality of curvatures. In this case, the smoothing reference line SRL may be configured by connecting a plurality of circles having mutually different radii. In one embodiment, as shown in FIG. 6, the smoothing reference line SRL may include a plurality of sub-smoothing reference lines. For example, the smoothing reference line SRL having the curvatures may be a boundary between the display region and the non-display region in the corner region RC of the display panel. As another example, the smoothing reference line SRL having the curvatures may be a boundary between the display region and the non-display region in the trench region TR. Each of the sub-smoothing reference lines may be a part of a circumference of a circle having a radius that is different from radii of a plurality of circles corresponding to other sub-smoothing reference lines. The method of determining the pixel luminance of FIG. 1 may include dividing a smoothing reference line SRL having N curvatures (where N is a natural number of 2 or more) into N sub-smoothing reference lines corresponding to each of the curvatures. In FIG. 6, a smoothing reference line SRL having three curvatures has been illustrated. In this case, the method of determining the pixel luminance of FIG. 1 may include dividing the smoothing reference line SRL into a first sub-smoothing reference line, a second sub-smoothing reference line, and a third sub-smoothing reference line corresponding to each of the curvatures. A circular arc 1 of the first sub-smoothing reference line may have a radius of 255 pixel lengths, a circular arc 2 of the second sub-smoothing reference line may have a radius of 37 pixel lengths, and a circular arc 3 of the third sub-smoothing reference line may have a radius of 230 pixel lengths. In this case, a pixel length, which is a unit of the radius, may refer to a diameter of one pixel. In other words, the smoothing reference line SRL of FIG. 6 may be a curved line having a shape in which the circular arc 1 having the radius of 255 pixel lengths, the circular arc 2 having the radius of 37 pixel lengths, and the circular arc 3 having the radius of 230 pixel lengths are connected to each other. The method of determining the pixel luminance of FIG. 1 may include dividing the boundary pixel BP into the first pixel region FPR directed toward the display region and the second pixel region SPR directed toward the non-display region based on each of the sub-smoothing reference lines. For example, in the case of the smoothing reference line SRL of FIG. 6, the boundary pixels may be divided into three first pixel regions FPR and three second pixel regions SPR. As described above, the method of determining the pixel luminance of FIG. 1 includes dividing the smoothing reference line SRL into respective sub-smoothing reference lines, so that pixel luminance dimming may be performed based on each of the sub-smoothing reference lines. As another example of the smoothing reference line having the curvatures, referring to FIG. 7, the display panel may include boundary pixels BP through which each of the sub-smoothing reference lines passes, inner non-boundary pixels IP located in the display region, which do not allow each of the sub-smoothing reference lines to pass therethrough, and outer non-boundary pixels OP located in the non-display region, which do not allow each of the sub-smoothing reference lines to pass therethrough. Accordingly, as shown in FIG. 7, the boundary pixel BP may be divided into the first pixel region FPR directed toward the display region and the second pixel region SPR directed toward the non-display region based on each of the sub-smoothing reference lines. Meanwhile, the outer non-boundary pixels OP may not exist on the display panel, or may not emit light (e.g., the smoothing rate is 0) when the inner non-boundary pixels IP and the boundary pixels BP emit light.

Thereafter, the method of determining the pixel luminance of FIG. 1 may include calculating a smoothing rate corresponding to a ratio of an area of the first pixel region FPR to a total area of the boundary pixel BP through which each of the sub-smoothing reference lines passes (S150), and determining a dimming luminance of the boundary pixel BP based on the smoothing rate (S160). As a result, as shown in FIG. 8, through a combination of each of the sub-smoothing reference lines, the boundary having a plurality of curvatures between the display region and the non-display region may be improved (i.e., denoted by IMP). In other words, while a conventional boundary having a plurality of curvatures (i.e., denoted by ST) may be configured such that a step difference is visually recognized by the user, the boundary having a plurality of curvatures that is improved by the method of determining the pixel luminance of FIG. 1 (i.e., denoted by NST) may be configured such that a step difference is not visually recognized by the user, or the visual recognition of the step difference is minimized (or reduced). However, since the calculation of the smoothing rate and the determination of the dimming luminance of the boundary pixel in the case where the smoothing reference line SRL has the curvatures are substantially the same as the calculation of the smoothing rate and the determination of the dimming luminance of the boundary pixel in the case where the smoothing reference line SRL does not have the curvatures except that the calculation of the smoothing rate and the determination of the dimming luminance of the boundary pixel in the case where the smoothing reference line SRL has the curvatures are performed based on each of the sub-smoothing reference lines, redundant descriptions thereof will be omitted.

Figure 9:
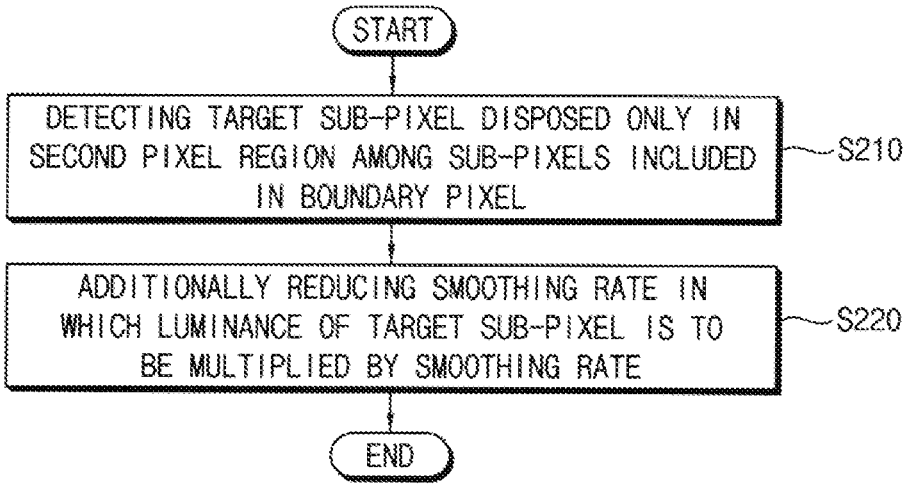
FIG. 9 is a flowchart illustrating one example of additionally reducing a smoothing rate to be applied to a target sub-pixel in the method of determining the pixel luminance of FIG. 1.
Figure 10A:
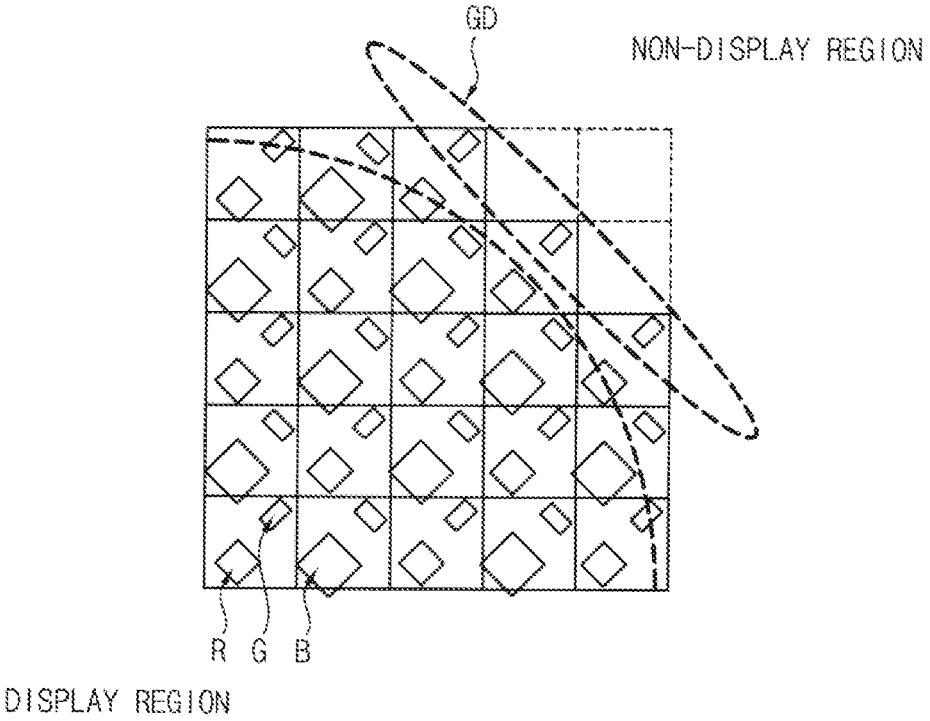
FIG. 10A and FIG. 10B are diagrams for describing one example of additionally reducing the smoothing rate to be applied to the target sub-pixel in the method of determining the pixel luminance of FIG. 1.
Figure 10B:
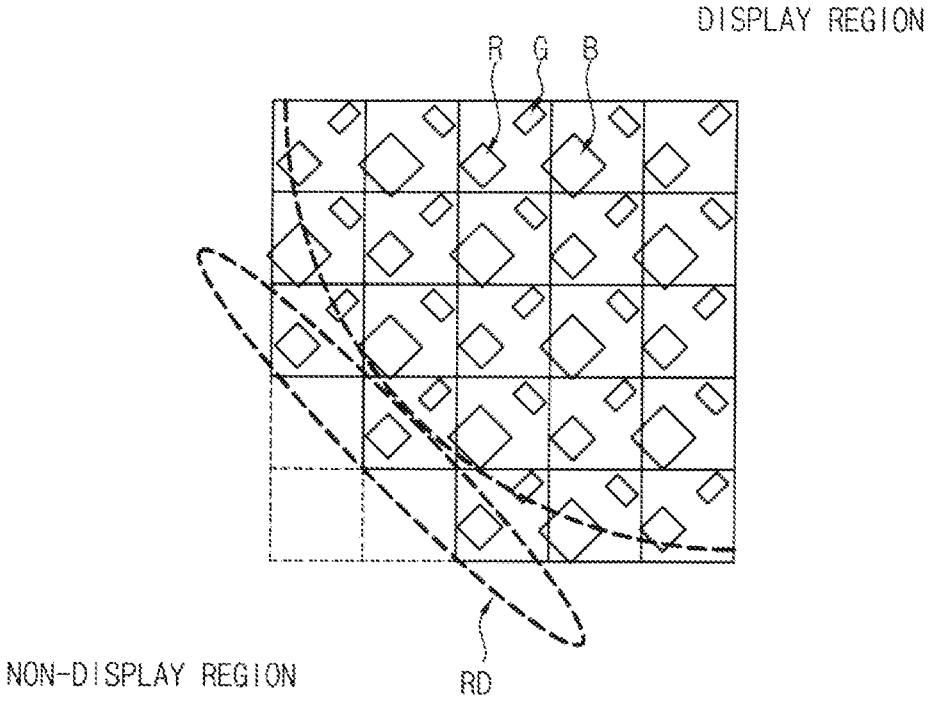

FIG. 9 is a flowchart illustrating one example of additionally reducing a smoothing rate to be applied to a target sub-pixel in the method of determining the pixel luminance of FIG. 1, and FIGS. 10A and 10B are diagrams for describing one example of additionally reducing the smoothing rate to be applied to the target sub-pixel in the method of determining the pixel luminance of FIG. 1.

Referring to FIGS. 9 to 10B, the method of determining the pixel luminance of FIG. 1 may include detecting a target sub-pixel disposed only in the second pixel region SPR among sub-pixels R, G, and B included in the boundary pixel BP through which the smoothing reference line SRL passes (S210), and additionally reducing the smoothing rate in which a luminance of the target sub-pixel disposed only in the second pixel region SPR is to be multiplied by the smoothing rate (S220). For example, as shown in FIGS. 10A and 10B, the sub-pixels R, G, and B included in the display panel may be arranged in a diamond structure. In this case, one pixel may include a red sub-pixel R and a green sub-pixel G, or may include a blue sub-pixel B and the green sub-pixel G. In this case, a specific sub-pixel in the boundary pixel BP through which the smoothing reference line SRL passes may be located outside the smoothing reference line SRL (i.e., in a direction toward the non-display region). For example, in FIG. 10A, since green sub-pixels G in the boundary pixels BP are located in series outside the smoothing reference line SRL, a problem that a green color is strongly recognized outside the smoothing reference line SRL may occur (i.e., denoted by GD). As another example, in FIG. 10B, since red sub-pixels R in the boundary pixels BP are located in series outside the smoothing reference line SRL, a problem that a red color is strongly recognized outside the smoothing reference line SRL may occur (i.e., denoted by RD). Accordingly, in a state shown in FIG. 10A, the method of determining the pixel luminance of FIG. 1 may include additionally reducing the smoothing rate in which a luminance of the green sub-pixel G among the sub-pixels R, G, and B included in the boundary pixel BP through which the smoothing reference line SRL passes is to be multiplied by the smoothing rate, so that the problem that the green color is strongly recognized outside the smoothing reference line SRL may be solved. Similarly, in a situation shown in FIG. 10B, the method of determining the pixel luminance of FIG. 1 may include additionally reducing the smoothing rate in which a luminance of the red sub-pixel R among the sub-pixels R, G, and B included in the boundary pixel BP through which the smoothing reference line SRL passes is to be multiplied by the smoothing rate, so that the problem that the red color is strongly recognized outside the smoothing reference line SRL may be solved. As described above, the method of determining the pixel luminance of FIG. 1 includes additionally reducing the smoothing rate in which the luminance of the target sub-pixel disposed only in the second pixel region SPR among the sub-pixels R, G, and B included in the boundary pixel BP through which the smoothing reference line SRL passes is to be multiplied by the smoothing rate, so that a problem that a specific color is strongly recognized outside the smoothing reference line SRL may be solved. Meanwhile, even when the smoothing reference line SRL has the curvatures, the method of determining the pixel luminance of FIG. 1 may include dividing the smoothing reference line SRL into respective sub-smoothing reference lines, and additionally reducing the smoothing rate in which the luminance of the target sub-pixel disposed only in the second pixel region SPR among the sub-pixels R, G, and B included in the boundary pixel BP through which each of the sub-smoothing reference lines passes is to be multiplied by the smoothing rate, so that the problem that the specific color is strongly recognized outside the smoothing reference line SRL having the curvatures may be solved.

Figure 11:
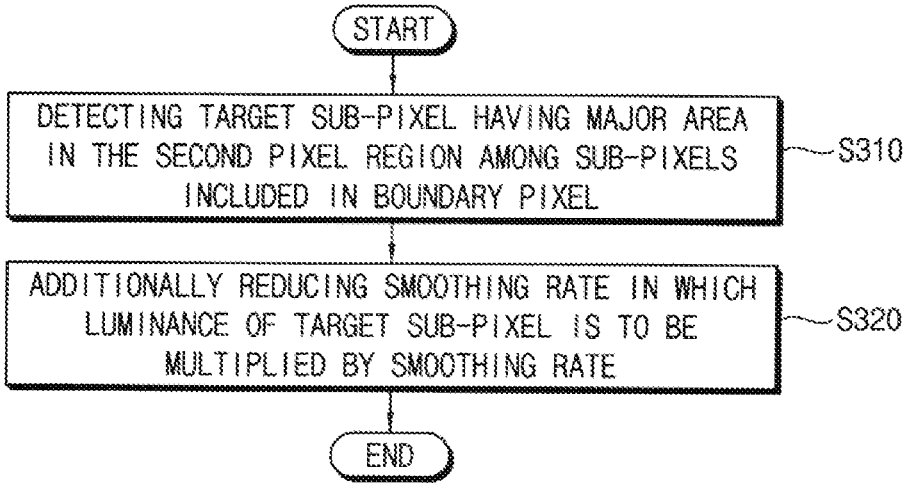
FIG. 11 is a flowchart illustrating another example of additionally reducing the smoothing rate to be applied to the target sub-pixel in the method of determining the pixel luminance of FIG. 1.
Figure 12:
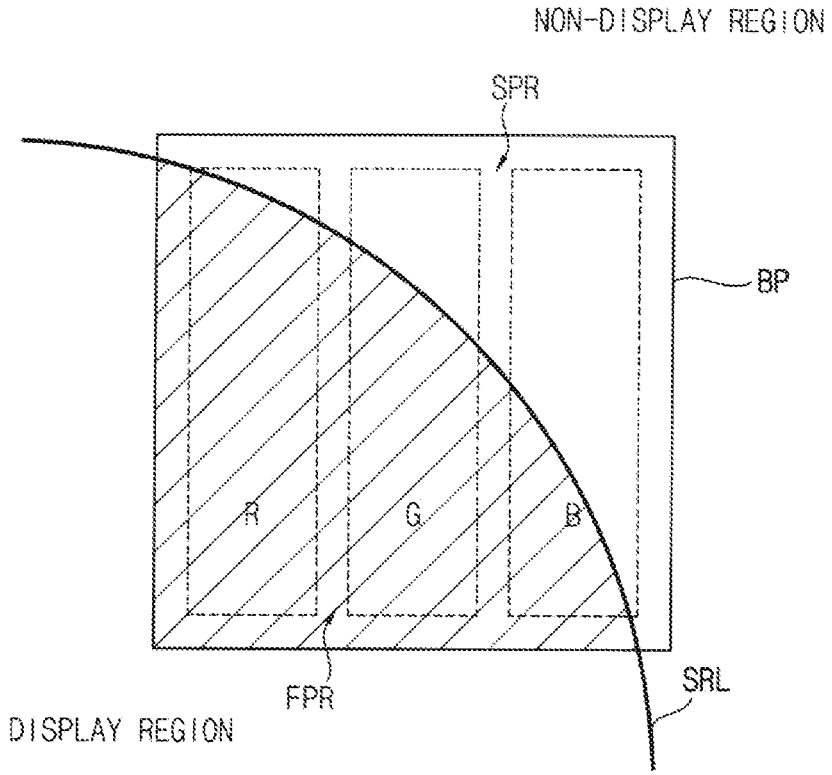
FIG. 12 is a diagram for describing another example of additionally reducing the smoothing rate to be applied to the target sub-pixel in the method of determining the pixel luminance of FIG. 1.

FIG. 11 is a flowchart illustrating another example of additionally reducing the smoothing rate to be applied to the target sub-pixel in the method of determining the pixel luminance of FIG. 1; and FIG. 12 is a diagram for describing another example of additionally reducing the smoothing rate to be applied to the target sub-pixel in the method of determining the pixel luminance of FIG. 1.

Referring to FIGS. 11 and 12, the method of determining the pixel luminance of FIG. 1 may include detecting a target sub-pixel having a major area in the second pixel region SPR among sub-pixels R, G, and B included in the boundary pixel BP through which the smoothing reference line SRL passes (S310), and additionally reducing the smoothing rate in which a luminance of the target sub-pixel having the major area in the second pixel region SPR is to be multiplied by the smoothing rate (S320). For example, as shown in FIG. 12, the sub-pixels R, G, and B included in the display panel may be arranged in an RGB stripe structure. In this case, one pixel may include a red sub-pixel R, a green sub-pixel G, and a blue sub-pixel B, which are arranged in parallel with each other in a specific direction. In this case, a specific sub-pixel in the boundary pixel BP through which the smoothing reference line SRL passes may have a major area outside the smoothing reference line SRL (i.e., in a direction toward the non-display region). For example, in FIG. 9, since the blue sub-pixel B has a major area outside the smoothing reference line SRL, a problem that a blue color is strongly recognized outside the smoothing reference line SRL may occur. Accordingly, in a state shown in FIG. 12, the method of determining the pixel luminance of FIG. 1 may include additionally reducing the smoothing rate in which a luminance of the blue sub-pixel B among the sub-pixels R, G, and B included in the boundary pixel BP through which the smoothing reference line SRL passes is to be multiplied by the smoothing rate, so that the problem that a blue color is strongly recognized outside the smoothing reference line SRL may be solved. As described above, the method of determining the pixel luminance of FIG. 1 includes additionally reducing the smoothing rate in which the luminance of the target sub-pixel having the major area in the second pixel region SPR among the sub-pixels R, G, and B included in the boundary pixel BP through which the smoothing reference line SRL passes is to be multiplied by the smoothing rate, so that a problem that a specific color is strongly recognized outside the smoothing reference line SRL may be solved. Meanwhile, even when the smoothing reference line SRL has the curvatures, the method of determining the pixel luminance of FIG. 1 may include dividing the smoothing reference line SRL into respective sub-smoothing reference lines, and additionally reducing the smoothing rate in which the luminance of the target sub-pixel having the major area in the second pixel region SPR among the sub-pixels R, G, and B included in the boundary pixel BP through which each of the sub-smoothing reference lines passes is to be multiplied by the smoothing rate, so that the problem that the specific color is strongly recognized outside the smoothing reference line SRL having the curvatures may be solved.

Figure 13:
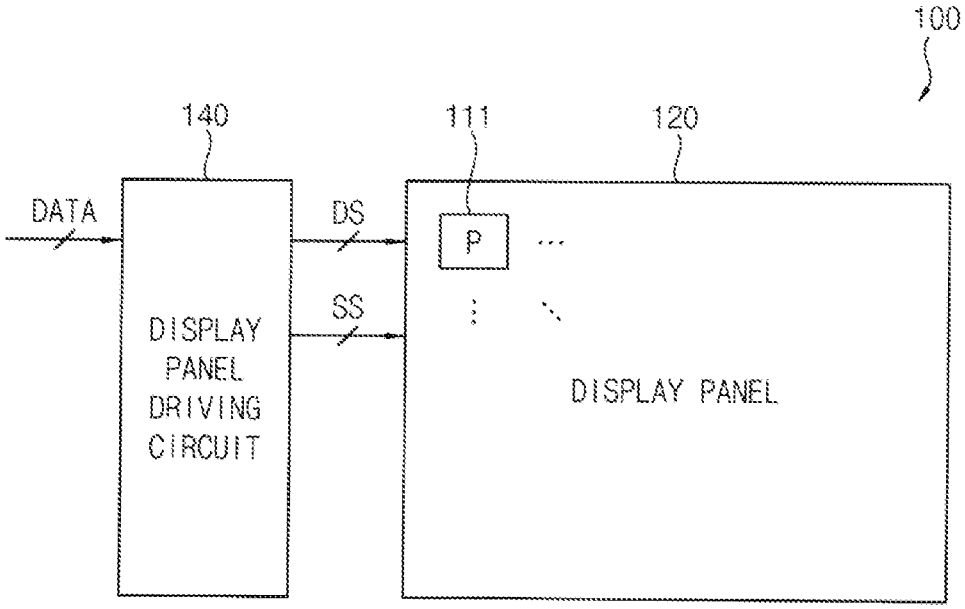
FIG. 13 is a block diagram illustrating a display device according to embodiments of the inventive concepts.

FIG. 13 is a block diagram illustrating a display device according to embodiments of the inventive concepts.

Referring to FIG. 13, a display device 100 may include a display panel 120 and a display panel driving circuit 140. For example, the display device 100 may be an organic light emitting diode display device, but the inventive concepts are not limited thereto.

The display panel 120 may include a plurality of pixels 111. In this case, each of the pixels 111 may include at least two of a red sub-pixel, a green sub-pixel, and a blue sub-pixel. Meanwhile, the display panel 120 may include a display region and a non-display region. For example, the non-display region may be a corner region of the display panel, which is processed to be a curved line. In this case, a boundary between the display region and the non-display region may be a curved line. As another example, the non-display region may be a hole region or a trench region through which light for an operation of an optical module is transmitted. In this case, the boundary between the display region and the non-display region may be a curved line. The display panel driving circuit 140 may be configured to drive the display panel 120. To this end, the display panel driving circuit 140 may include a scan driver, a data driver, and a timing controller. The display panel 120 may be connected to the scan driver through scan lines, and may be connected to the data driver through data lines. The scan driver may provide a scan signal SS to the display panel 120 through the scan lines. In other words, the scan driver may provide the scan signal SS to the pixels 111. The data driver may provide a data signal DS (or a data voltage) to the display panel 120 through the data lines. In other words, the data driver may provide the data signal DS to the pixels 111. The timing controller may control the scan driver and the data driver by generating a plurality of control signals and providing the generated control signals to the scan driver and data driver. Meanwhile, the timing controller may perform a predetermined processing (e.g., degradation compensation, etc.) on image data DATA input from an external component (e.g., a graphic processing unit (GPU), etc.). In some embodiments, when the display device 100 is an organic light emitting diode display device, the display panel driving circuit 140 may further include an emission control driver. In this case, the display panel 120 may be connected to the emission control driver through emission control lines, and the emission control driver may provide an emission control signal to the display panel 120 through the emission control lines. In other words, the emission control driver may provide the emission control signal to the pixels 111.

In one embodiment, the display panel driving circuit 140 may be configured to determine a smoothing reference line between the display region and the non-display region in the display panel 120, determine a boundary pixel through which the smoothing reference line passes among pixels included in the display region, and determine whether the smoothing reference line has a plurality of curvatures. When the smoothing reference line does not have the plurality of curvatures, the display panel driving circuit 140 may be configured to divide the boundary pixel into a first pixel region directed toward the display region and a second pixel region directed toward a non-display region based on the smoothing reference line, calculate a smoothing rate corresponding to a ratio of an area of the first pixel region to a total region of the boundary pixel, determine a dimming luminance of the boundary pixel based on the smoothing rate, and perform luminance compensation for reflecting the dimming luminance of the boundary pixel on the image data DATA. When the smoothing reference line has the plurality of curvatures, the display panel driving circuit 140 may be configured to divide the smoothing reference line into a plurality of sub-smoothing reference lines corresponding to each of the curvatures, divide the boundary pixels into a first pixel region directed toward the display region and a second pixel region directed toward the non-display region based on each of the sub-smoothing reference lines, and perform luminance compensation for reflecting the dimming luminance of the boundary pixel on the image data DATA. In this case, the display panel driving circuit 140 may be configured to calculate the dimming luminance of the boundary pixel by multiplying a luminance of the boundary pixel by the smoothing rate. In addition, the display panel driving circuit 140 may be configured to calculate a dimming luminance of each of sub-pixels included in the boundary pixel by multiplying a luminance of each of the sub-pixels by the smoothing rate. In some embodiments, the display panel driving circuit 140 may be configured to detect a target sub-pixel disposed only in the second pixel region among the sub-pixels included in the boundary pixel, and additionally reduce the smoothing rate in which a luminance of the target sub-pixel is to be multiplied by the smoothing rate. In some embodiments, the display panel driving circuit 140 may be configured to detect a target sub-pixel having a major area in the second pixel region among the sub-pixels included in the boundary pixel, and additionally reduce the smoothing rate in which a luminance of the target sub-pixel is to be multiplied by the smoothing rate. However, since the above configuration has been described above, redundant descriptions thereof will be omitted.

As described above, the display device 100 may be configured to determine a smoothing reference line between the display region and the non-display region in the display panel 120, determine a boundary pixel through which the smoothing reference line passes among the pixels 111 included in the display region, divide the boundary pixel into a first pixel region directed toward the display region and a second pixel region directed toward a non-display region based on the smoothing reference line, calculate a smoothing rate corresponding to a ratio of an area of the first pixel region to a total region of the boundary pixel and determine a dimming luminance of the boundary pixel based on the smoothing rate (i.e., calculate a dimming luminance of the boundary pixel by multiplying a luminance of the boundary pixel by the smoothing rate), so that a step difference may be prevented from being generated by the pixels 111 even when the boundary between the display region and the non-display region in the display panel is a curved line having a plurality of curvatures. As a result, even when the boundary between the display region and the non-display region in the display panel 120 is the curved line having the plurality of curvatures, the display device 100 may prevent the step difference from being generated by the pixels 111 so as to prevent a user from recognizing the step difference, so that a high-quality image may be provided to the user.

Figure 14:
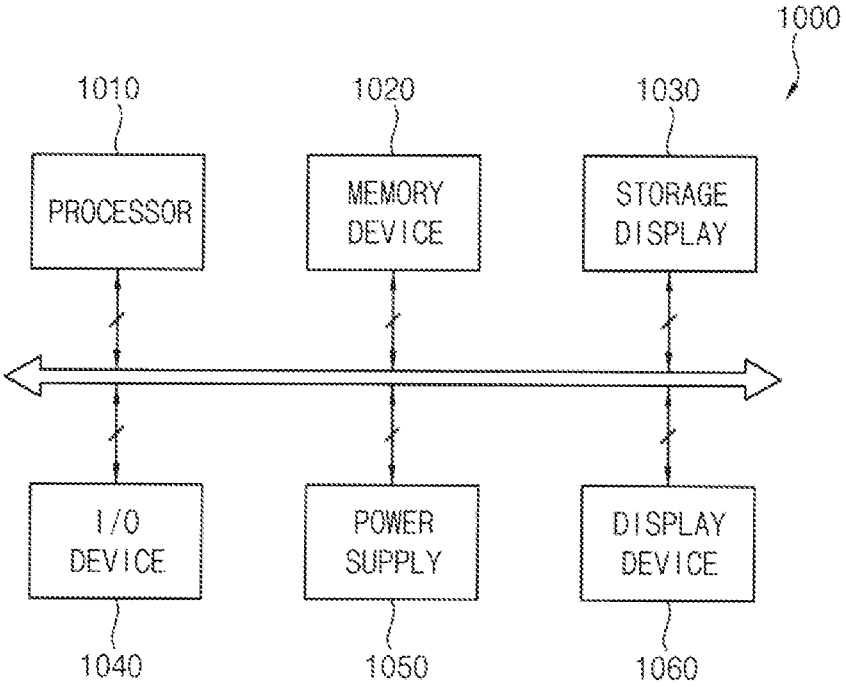
FIG. 14 is a block diagram illustrating an electronic device according to embodiments of the inventive concepts.
Figure 15:
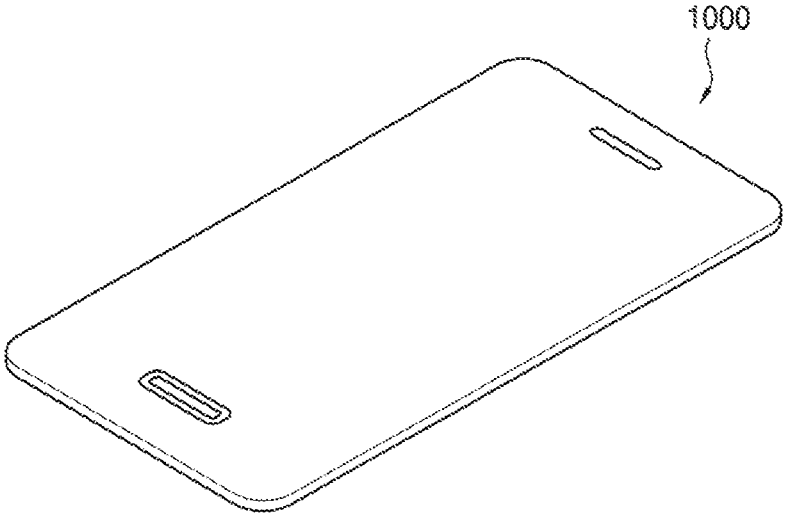
FIG. 15 is a diagram illustrating one example in which the electronic device of FIG. 14 is implemented as a smartphone.

FIG. 14 is a block diagram illustrating an electronic device according to embodiments of the inventive concepts. FIG. 15 is a diagram illustrating one example in which the electronic device of FIG. 14 is implemented as a smartphone.

Referring to FIGS. 14 and 15, the electronic device 1000 may include a processor 1010, a memory device 1020, a storage device 1030, an input/output (UO) device 1040, a power supply 1050, and a display device 1060. In addition, the electronic device 1000 may further include a plurality of ports for communicating with a video card, a sound card, a memory card, a universal serial bus (USB) device, other electronic device, and the like. In an embodiment, as illustrated in FIG. 15, the electronic device 1000 may be implemented as a smart phone. However, the electronic device 1000 is not limited thereto. For example, the electronic device 1000 may be implemented as a cellular phone, a video phone, a smart pad, a smart watch, a tablet PC, a car navigation system, a computer monitor, a laptop, a head mounted display (HMD) device, and the like.

The processor 1010 may perform various computing functions. The processor 1010 may be a micro-processor, a central processing unit (CPU), an application processor (AP), and the like. The processor 1010 may be coupled to other components via an address bus, a control bus, a data bus, and the like. Further, the processor 1010 may be coupled to an extended bus such as a peripheral component interconnection (PCI) bus. The memory device 1020 may store data for operations of the electronic device 1000. For example, the memory device 1020 may include at least one non-volatile memory device such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, and the like and/or at least one volatile memory device such as a dynamic random access memory (DRAM) device, a static random access memory (SRAM) device, a mobile DRAM device, and the like. The storage device 1030 may include a solid state drive (SSD) device, a hard disk drive (HDD) device, a CD-ROM device, and the like. The I/O device 1040 may include an input device such as a keyboard, a keypad, a mouse device, a touch-pad, a touch-screen, and the like, and an output device such as a printer, a speaker, and the like. In some embodiments, the I/O device 1040 may include the display device 1060. The power supply 1050 may provide power for operations of the electronic device 1000.

The display device 1060 may display an image corresponding to visual information of the electronic device 1000. For example, the display device 1060 may be an organic light emitting display device, but the display device 1060 is not limited thereto. According to an embodiment, the display device 1060 may be included in the I/O device 1040. The display device 1060 may include a display panel including a display region and a non-display region, and a display panel driving circuit configured to drive the display panel. The display panel driving circuit may be configured to determine a smoothing reference line between the display region and the non-display region in the display panel, determine a boundary pixel through which the smoothing reference line passes among pixels included in the display region, divide the boundary pixel into a first pixel region directed toward the display region and a second pixel region directed toward the non-display region based on the smoothing reference line, calculate a smoothing rate corresponding to a ratio of an area of the first pixel region to a total area of the boundary pixel, determine a dimming luminance of the boundary pixel based on the smoothing rate and perform luminance compensation for reflecting the dimming luminance of the boundary pixel on image data. As a result, step difference can be prevented from being generated by the pixels even when the boundary between the display region and the non-display region in the display panel is the curved line having the curvatures, and thus a high-quality image can be provided to the user. However, since these are described above, duplicated descriptions related thereto will not be repeated.

The foregoing is illustrative of the inventive concepts and is not to be construed as limiting thereof. Although a few embodiments of the inventive concepts have been described, those skilled in the art will readily appreciate that many modifications are possible in the embodiments without materially departing from the novel teachings and advantages of the inventive concepts. Accordingly, all such modifications are intended to be included within the scope of the inventive concepts as defined in the claims. In the claims, means-plus-function clauses are intended to cover the structures described herein as performing the recited function and not only structural equivalents but also equivalent structures. Therefore, it is to be understood that the foregoing is illustrative of the inventive concepts and is not to be construed as limited to the specific embodiments disclosed, and that modifications to the disclosed embodiments, as well as other embodiments, are intended to be included within the scope of the appended claims. The inventive concepts are defined by the following claims, with equivalents of the claims to be included therein.

What is claimed is:

1. A method of determining a pixel luminance, the method comprising:

determining a smoothing reference line between a display region and a non-display region in a display panel;

determining a boundary pixel through which the smoothing reference line passes among pixels included in the display region;

dividing the boundary pixel into a first pixel region directed toward the display region and a second pixel region directed toward the non-display region based on the smoothing reference line;

calculating a smoothing rate corresponding to a ratio of an area of the first pixel region to a total area of the boundary pixel; and determining a dimming luminance of the boundary pixel based on the smoothing rate, wherein, when the smoothing reference line has a plurality of curvatures, the smoothing reference line is divided into a plurality of sub-smoothing reference lines corresponding to each of the plurality of curvatures, the smoothing rate is calculated based on each of the sub-smoothing reference lines, and luminance dimming of the boundary pixel corresponding to the sub-smoothing reference line is performed based on the smoothing rate.

2. The method of claim 1, wherein the sub-smoothing reference lines are parts of circumferences of circles having mutually different radii, respectively.

3. The method of claim 1, wherein the dimming luminance of the boundary pixel is calculated by multiplying a luminance of the boundary pixel by the smoothing rate.

4. The method of claim 3, wherein a dimming luminance of each of sub-pixels included in the boundary pixel is calculated by multiplying a luminance of each of the sub-pixels by the smoothing rate.

5. The method of claim 1, wherein the smoothing reference line includes a curved line that is bent convexly toward the display region.

6. The method of claim 5, wherein the non-display region includes a trench region or a hole region for an optical module disposed under the display panel.

7. The method of claim 1, wherein the smoothing reference line includes a curved line that is bent convexly toward the non-display region.

8. The method of claim 7, wherein the non-display region includes a corner region of the display panel.

9. The method of claim 1, further comprising:

detecting a target sub-pixel disposed only in the second pixel region among sub-pixels included in the boundary pixel; and additionally reducing the smoothing rate in which a luminance of the target sub-pixel is to be multiplied by the smoothing rate.

10. The method of claim 1, further comprising:

detecting a target sub-pixel having a major area in the second pixel region among sub-pixels included in the boundary pixel; and additionally reducing the smoothing rate in which a luminance of the target sub-pixel is to be multiplied by the smoothing rate.

11. A display device comprising:

a display panel including a display region and a non-display region; and a display panel driving circuit configured to drive the display panel, wherein the display panel driving circuit is configured to:

determine a smoothing reference line between the display region and the non-display region in the display panel;

determine a boundary pixel through which the smoothing reference line passes among pixels included in the display region;

divide the boundary pixel into a first pixel region directed toward the display region and a second pixel region directed toward the non-display region based on the smoothing reference line;

calculate a smoothing rate corresponding to a ratio of an area of the first pixel region to a total area of the boundary pixel;

determine a dimming luminance of the boundary pixel based on the smoothing rate; and perform luminance compensation for reflecting the dimming luminance of the boundary pixel on image data, and, when the smoothing reference line has a plurality of curvatures, the display panel driving circuit is configured to:

divide the smoothing reference line into a plurality of sub-smoothing reference lines corresponding to each of the curvatures;

calculate the smoothing rate based on each of the sub-smoothing reference lines; and perform luminance dimming of the boundary pixel corresponding to the sub-smoothing reference line based on the smoothing rate.

12. The display device of claim 11, wherein the sub-smoothing reference lines are parts of circumferences of circles having mutually different radii, respectively.

13. The display device of claim 11, wherein the display panel driving circuit is configured to calculate the dimming luminance of the boundary pixel by multiplying a luminance of the boundary pixel by the smoothing rate.

14. The display device of claim 13, wherein the display panel driving circuit is configured to calculate a dimming luminance of each of sub-pixels included in the boundary pixel by multiplying a luminance of each of the sub-pixels by the smoothing rate.

15. The display device of claim 11, wherein the smoothing reference line includes a curved line that is bent convexly toward the display region.

16. The display device of claim 15, wherein the non-display region includes a trench region or a hole region for an optical module disposed under the display panel.

17. The display device of claim 11, wherein the smoothing reference line includes a curved line that is bent convexly toward the non-display region.

18. The display device of claim 17, wherein the non-display region includes a corner region of the display panel.

19. The display device of claim 11, wherein the display panel driving circuit is configured to:

detect a target sub-pixel disposed only in the second pixel region among sub-pixels included in the boundary pixel; and additionally reduce the smoothing rate in which a luminance of the target sub-pixel is to be multiplied by the smoothing rate.

20. The display device of claim 11, wherein the display panel driving circuit is configured to:

detect a target sub-pixel having a major area in the second pixel region among sub-pixels included in the boundary pixel; and additionally reduce the smoothing rate in which a luminance of the target sub-pixel is to be multiplied by the smoothing rate.

* * * * *